US011040823B2

(12) United States Patent
Tomasi

(10) Patent No.: US 11,040,823 B2
(45) Date of Patent: Jun. 22, 2021

(54) CAPSULE FOR THE PREPARATION OF INFUSED OR SOLUBLE BEVERAGES

(71) Applicant: BISIO PROGETTI S.P.A., Alessandria (IT)

(72) Inventor: Roberto Tomasi, Alessandria (IT)

(73) Assignee: BISIO PROGETTI S.P.A., Alessandria (IT)

( * ) Notice: Subject to any disclaimer, the term of this patent is extended or adjusted under 35 U.S.C. 154(b) by 206 days.

(21) Appl. No.: 15/553,590

(22) PCT Filed: Feb. 15, 2016

(86) PCT No.: PCT/IB2016/050798

§ 371 (c)(1),
(2) Date: Aug. 25, 2017

(87) PCT Pub. No.: WO2016/135581

PCT Pub. Date: Sep. 1, 2016

(65) Prior Publication Data

US 2018/0044105 A1 Feb. 15, 2018

(30) Foreign Application Priority Data

Feb. 27, 2015 (IT) ..... BS2015A000028

(51) Int. Cl.
*B65D 85/804* (2006.01)
*B65D 77/20* (2006.01)
*B65D 77/24* (2006.01)

(52) U.S. Cl.
CPC ..... *B65D 85/8043* (2013.01); *B65D 77/2024* (2013.01); *B65D 77/24* (2013.01)

(58) Field of Classification Search
CPC ... A47J 31/02; A47J 31/0642; B65D 85/8043; B65D 77/2024; B65D 77/24
See application file for complete search history.

(56) References Cited

U.S. PATENT DOCUMENTS 5,064,980 A * 11/1991 Grossman ..... A47J 31/547 219/689
5,221,028 A 6/1993 Dwinell
(Continued)

FOREIGN PATENT DOCUMENTS

WO 2015008309 A1 1/2015
WO WO-2015011689 A1 * 1/2015 ..... B65D 85/8043
WO WO-2015165627 A1 * 11/2015 ..... B65D 85/8043

OTHER PUBLICATIONS

International Search Report for PCT/IB2016/050798 dated May 25, 2016.

*Primary Examiner* — Viren A Thakur
(74) *Attorney, Agent, or Firm* — Thomas|Horstemeyer LLP

(57) ABSTRACT

A capsule (1) for the preparation of infused or soluble beverages comprises a cup (2) suitable to contain the substance (11) to be infused or dissolved, and provided with a bottom (3) with an opening (31) for the outflow of the infused beverage. The base (33) is provided with a plurality of reliefs (310, 320, 330, 340, 350, 360) having an upper surface devoid of cutting or puncture elements. The capsule (1) comprises a disc (5) suitable to seal the capsule (1) underneath, partially fixed to the base (33), in a releasable manner so as to be at least partially detached as a result of the increase of pressure inside the capsule (1). The opening of the capsule (1) for the release of the infused beverage occurs as a result of the deformation of the disc (5) by the pressure exerted by the fluid inside the capsule (1).

18 Claims, 11 Drawing Sheets

(56) References Cited

U.S. PATENT DOCUMENTS

| | | | | |
|---|---|---|---|---|
| 7,981,451 | B2 | 7/2011 | Ozanne | |
| 9,242,791 | B2 | 1/2016 | Denisart et al. | |
| 9,932,168 | B2 | 4/2018 | Hansen | |
| 2002/0020659 | A1* | 2/2002 | Sweeney | B65D 85/8043 210/416.3 |
| 2002/0078831 | A1* | 6/2002 | Cai | A47J 31/14 99/295 |
| 2007/0148290 | A1* | 6/2007 | Temite | B65D 85/8043 426/90 |
| 2010/0260896 | A1* | 10/2010 | Yoakim | B65D 85/8043 426/77 |
| 2010/0307930 | A1* | 12/2010 | Zangerle | B65D 85/8043 206/0.5 |
| 2012/0100259 | A1 | 4/2012 | Rapparini | |
| 2013/0216663 | A1* | 8/2013 | Dogan | B65D 85/8043 426/115 |
| 2014/0037803 | A1 | 2/2014 | Hansen | |
| 2014/0342059 | A1* | 11/2014 | Trombetta | B65D 85/8043 426/115 |
| 2017/0334624 | A1* | 11/2017 | Cabilli | B65D 65/466 |

* cited by examiner

CAPSULE FOR THE PREPARATION OF INFUSED OR SOLUBLE BEVERAGES

CROSS-REFERENCE TO RELATED APPLICATION

This application is the 35 U.S.C. § 371 national stage application of PCT Application No. PCT/IB62016/050798, filed Feb. 15, 2016, where the PCT claims priority to and the benefit of, IT Patent Application No. BS2015A000028, filed Feb. 27, 2015, both of which are herein incorporated by reference in their entireties.

This invention relates to a capsule for the preparation of infused or soluble beverages.

In particular, this invention relates a capsule for the packaging of concentrated products (for example in the form of powder, granules or leaves) in predetermined and disposable doses, for the extemporaneous preparation of beverages (such as tea, coffee, herbal tea, milk, chocolate, etc.) by means of the introduction, into the capsule itself, of a fluid under pressure (mostly hot water).

In the field of capsules or pods for coffee or other infusions, it is known to use automatic or semi-automatic machines equipped with a dispenser group suitable to produce an infusion through the passage of hot water under pressure through the capsule containing precisely the essence to be infused or dissolved. Examples of such known capsules notes are described in earlier documents US2010/260896, WO2015/008309 and U.S. Pat. No. 5,221,028.

The common operating principle of such machines provides for the piercing of the cover closing the capsule to allow the introduction of a flow of hot water under pressure by the infuser group. After obtaining the infusion of the essence contained in the capsule, the infused beverage flows out of the capsule and is directed by the machine into the cup or final container.

To prevent the pressurised fluid from passing through the substance to be infused too rapidly, without therefore spreading sufficiently inside the capsule with negative repercussions on the quality of the infused beverage, the known capsules are provided with a layer of sealing film, usually made of aluminium, placed on the bottom of the capsule in correspondence of a base provided with one or more cutting or piercing points or profiles. The increase of pressure in the capsule causes the pressurised fluid to push the aluminium layer against the points on the base until it is pierced or ruptured. Once the opening is created in the layer of sealing film, the infused beverage can flow out from a suitable opening in the base of the capsule itself.

These known capsules are rather complex from the constructive point of view, particularly as regards the realisation of the cutting and piercing points and profiles on the base. Therefore, these known capsules are rather expensive, especially as concerns the production of the related moulds.

The purpose of this invention is to provide a capsule for the preparation of infused or soluble beverages that solves the problems of the prior art.

In particular, the purpose of this invention is to provide a capsule for the preparation of infused or soluble beverages that is simple and inexpensive to manufacture compared to the known capsules, while still achieving similar performance in terms of quality of the infused beverage.

Another purpose of this invention is to provide a capsule for the preparation of infused or soluble beverages in which the opening of the capsule, to allow the infused beverage to flow out, occurs as a result of the deformation of the sealing disc, placed to cover the bottom of the capsule, due to the pressure exerted by the pressurised fluid inside it, thus avoiding recourse to any means of cutting or piercing as in the known capsules.

This purpose is achieved by a capsule for the preparation of infused or soluble beverages according to claim 1, by a method for the preparation of an infused beverage according to claim 12, by a method for welding a sealing disc to the base of a capsule according to claim 15 and by a corresponding welding tool according to claim 18.

The dependent claims describe preferred embodiments of the invention.

The characteristics and advantages of a capsule for the preparation of infused or soluble beverages according to this invention will be apparent from the following description, given by way of non-limiting example, in accordance with the accompanying figures, wherein.

Figure 12:
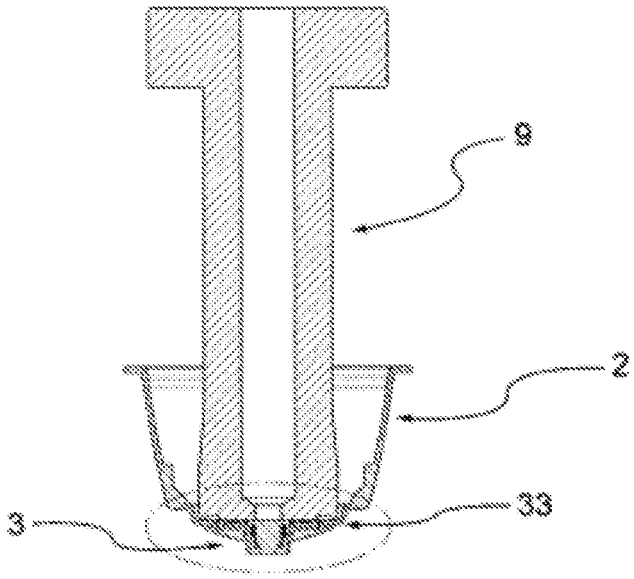
FIGS. 12 and 12A are, respectively, a sectional view and a detail of the welder of FIG. 9, in a step of welding the sealing disc on the bottom of the capsule, in a further embodiment variant.
Figure 12A:
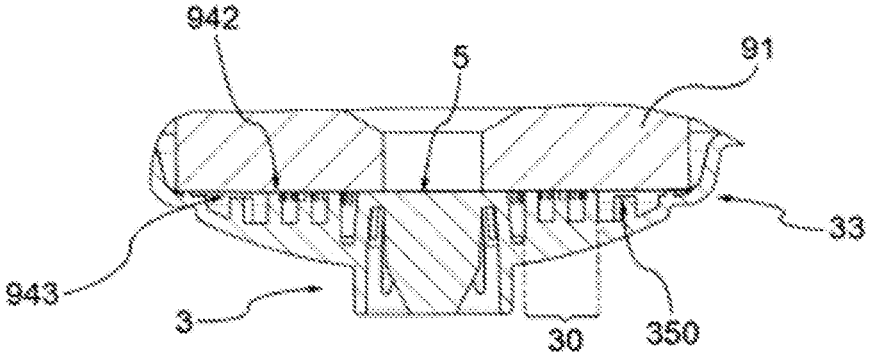
Figure 12B:
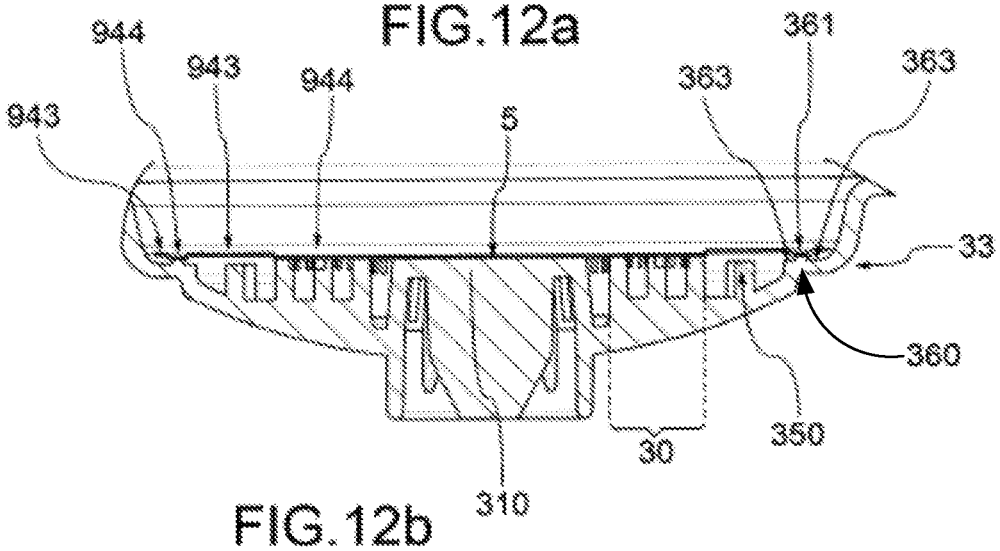

FIG. 12B; shows a detail of the sealing disc welded on the bottom of the capsule, in a further embodiment variant.

Figure 9:
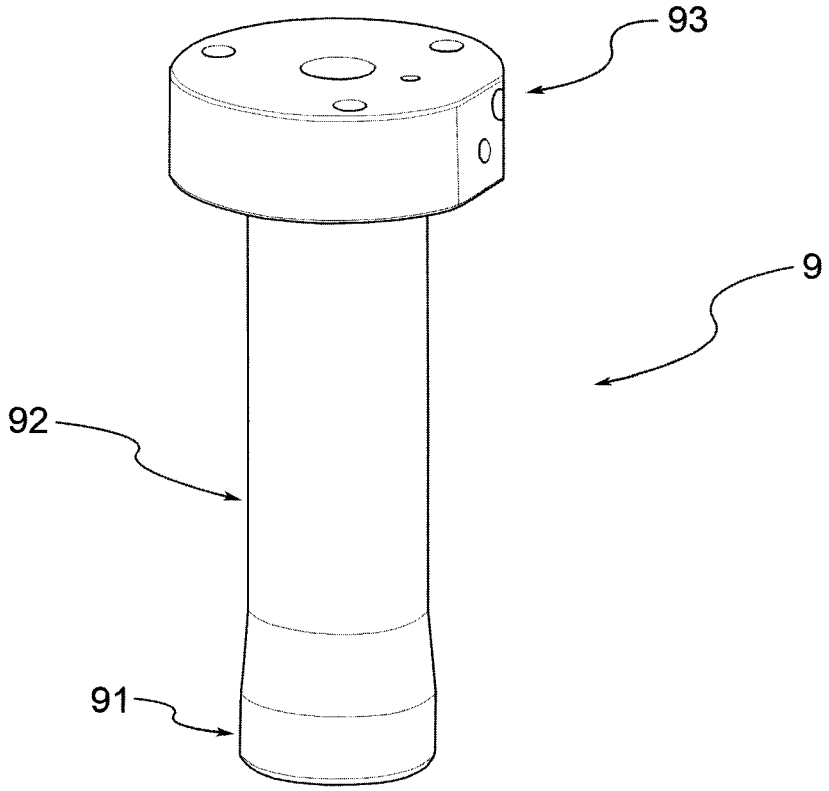
FIG. 9 is a perspective view of a welder for welding the sealing disc on the bottom of the capsule according to this invention.
Figure 10:
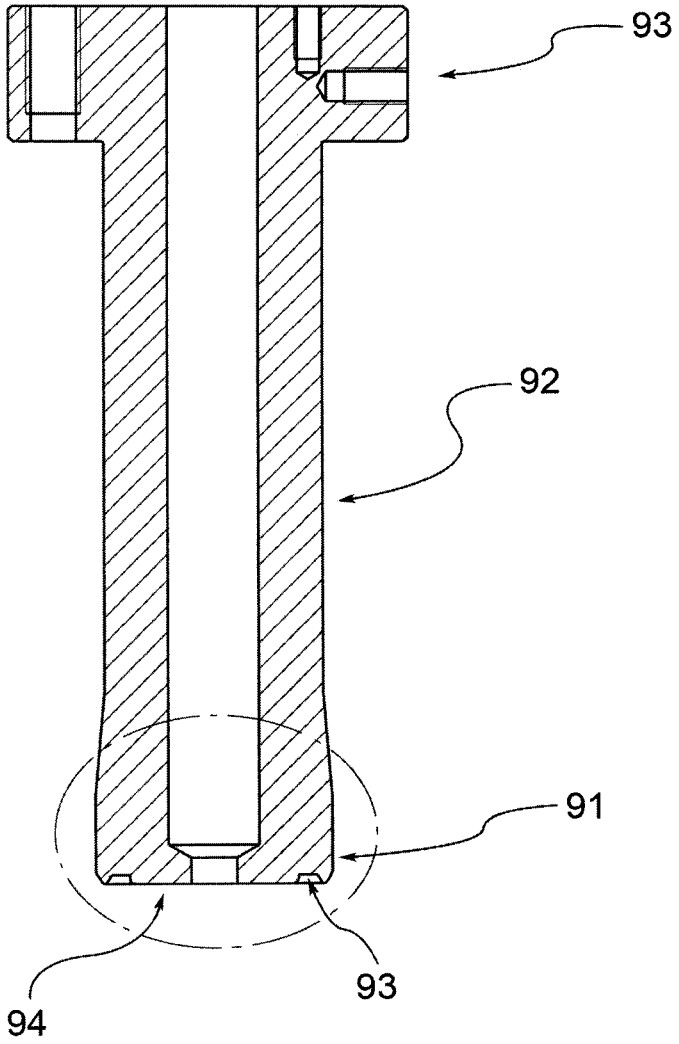
FIGS. 10 and 10A are, respectively, a sectional view and a detail of the welder of FIG. 9, in an embodiment variant.
Figure 10A:
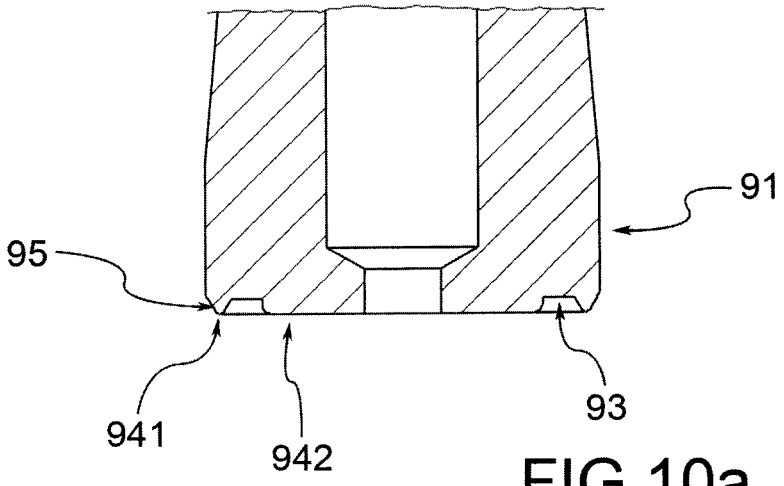
Figure 13:
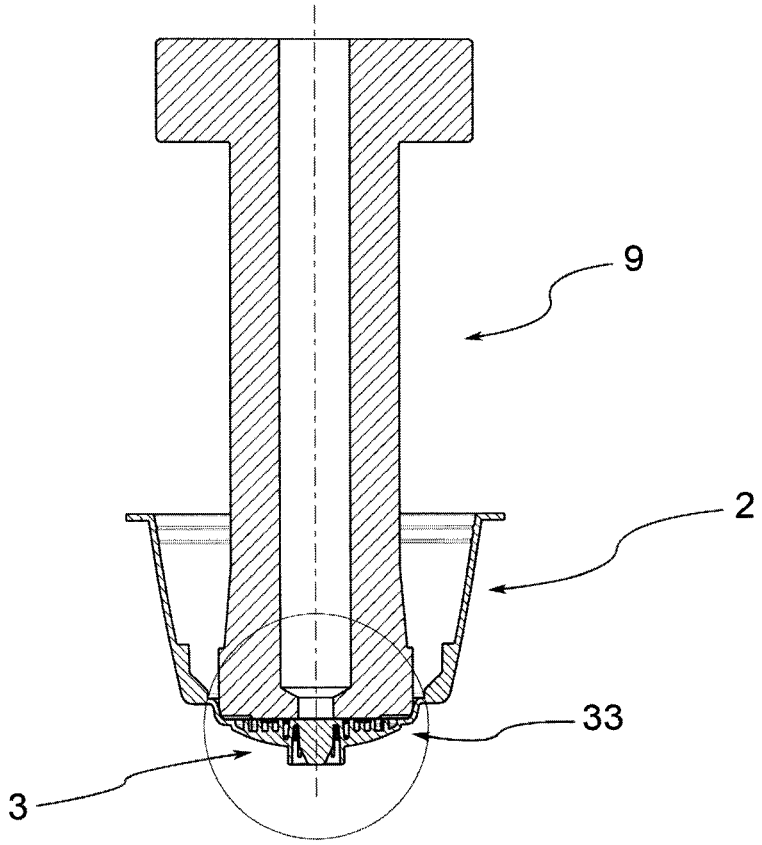
Figure 13A:
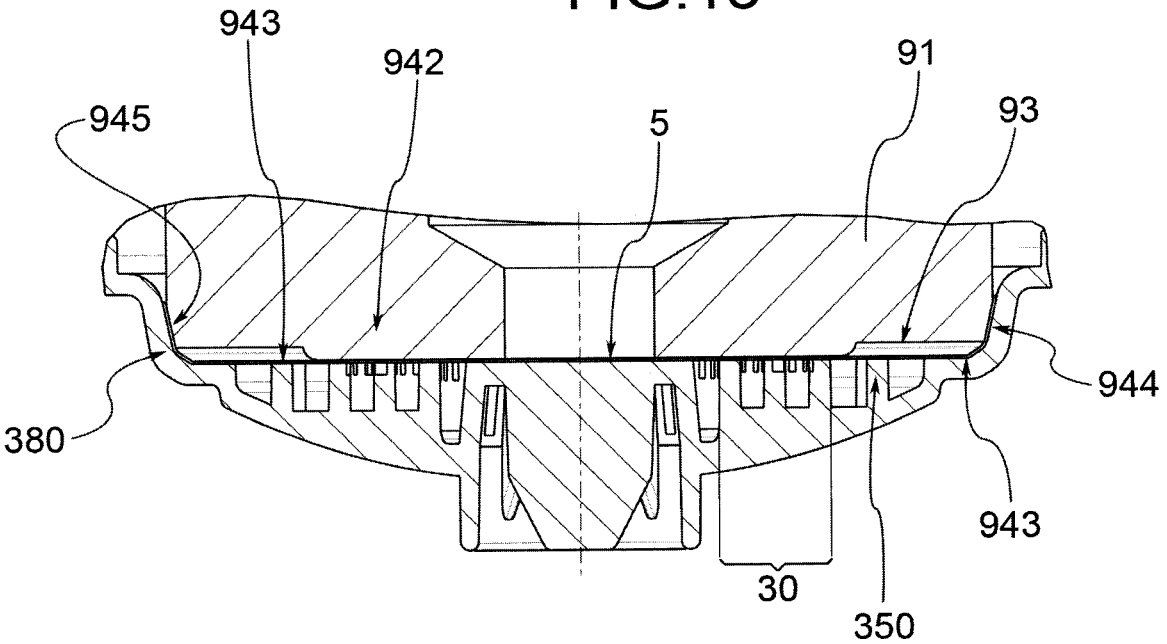
Figure 15B:
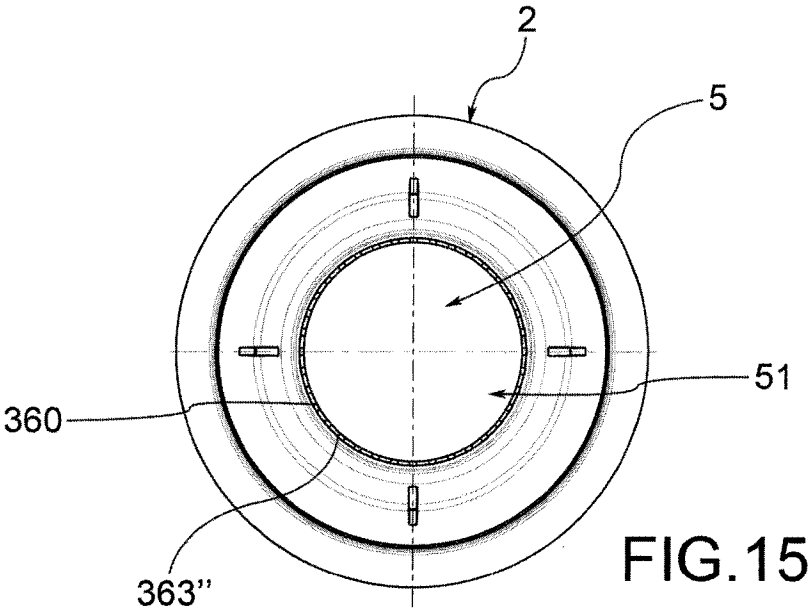
Figure 15C:
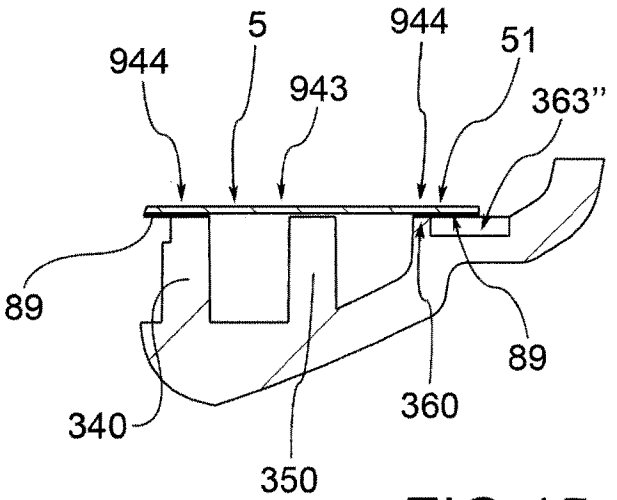
Figure 14:
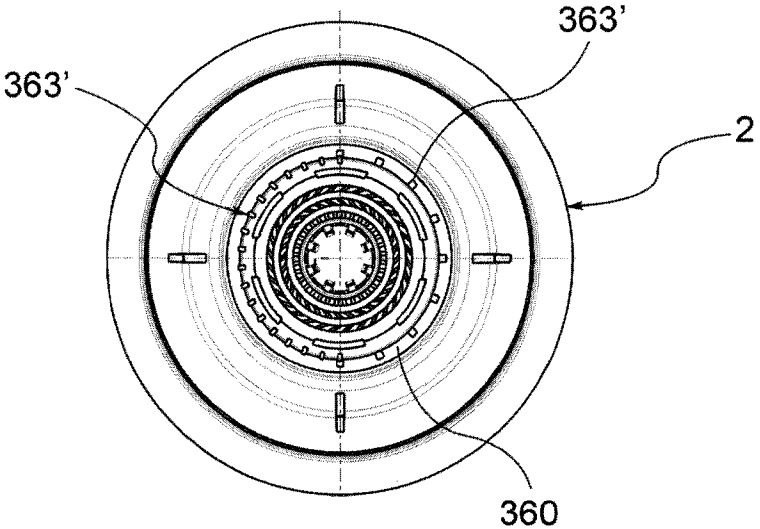
Figure 15A:
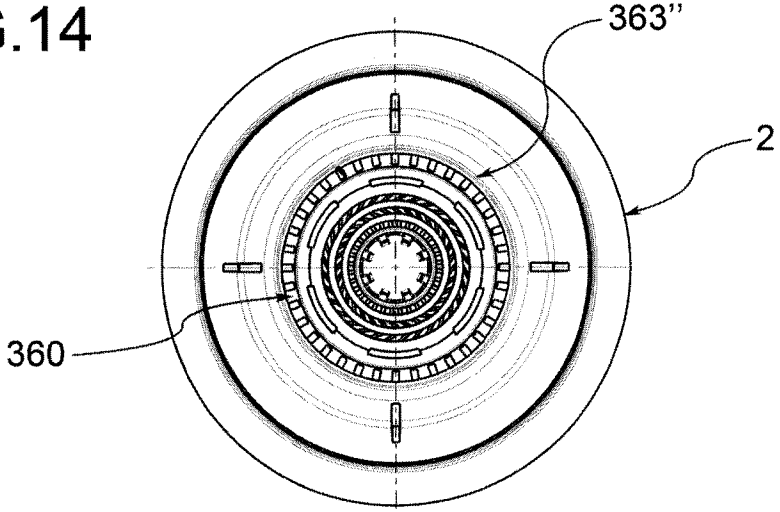

FIGS. 13 and 13A are, respectively, a sectional view and a detail of the welder of FIG. 9, in a step of welding the sealing disc on the bottom of the capsule, in a yet further embodiment variant;

FIG. 14 is a top view of two possible embodiment variants of the capsule provided with radial grooves inside the welding area of the rim of the sealing disc;

FIG. 15 is a top view of an embodiment variant of the capsule provided with radial grooves outside the welding area of the rim of the sealing disc;

FIGS. 15B and 15C are, respectively, a top view and a detail in section of the capsule of FIG. 15A with a sealing disc welded on the bottom.

Figure 6:
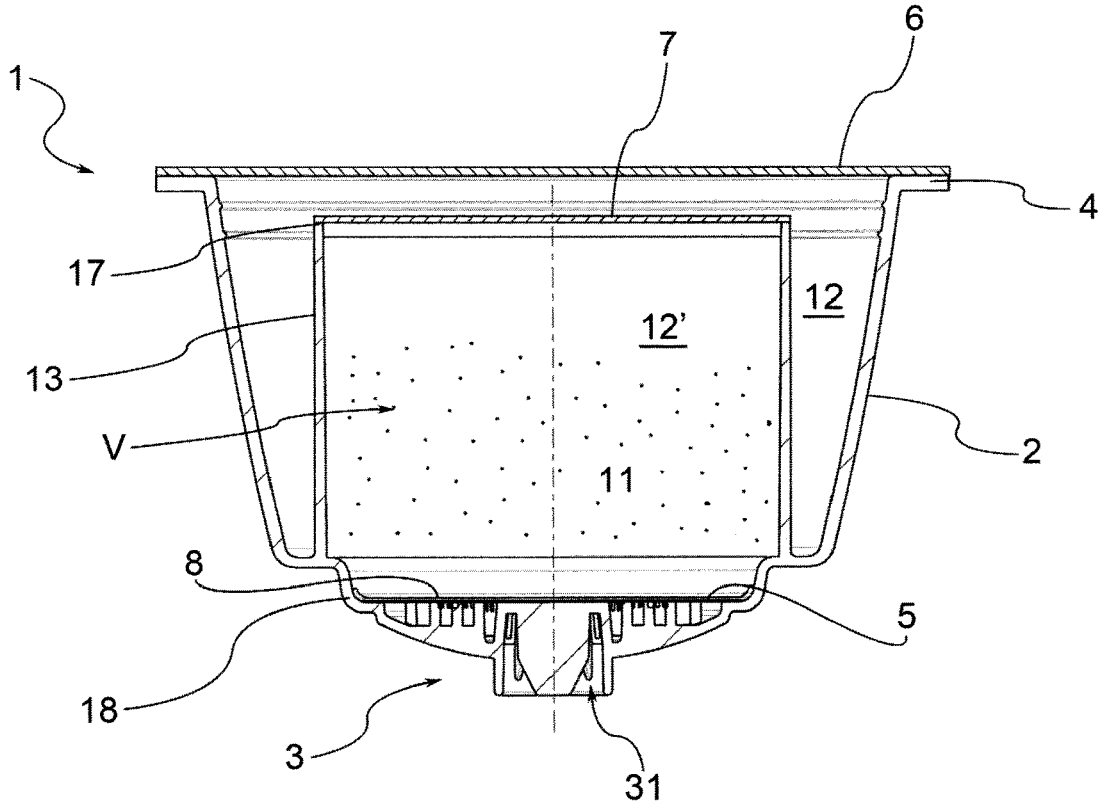
FIG. 6 is a sectional view of a capsule for the preparation of infused or soluble beverages according to this invention, in an embodiment variant.
Figure 8:
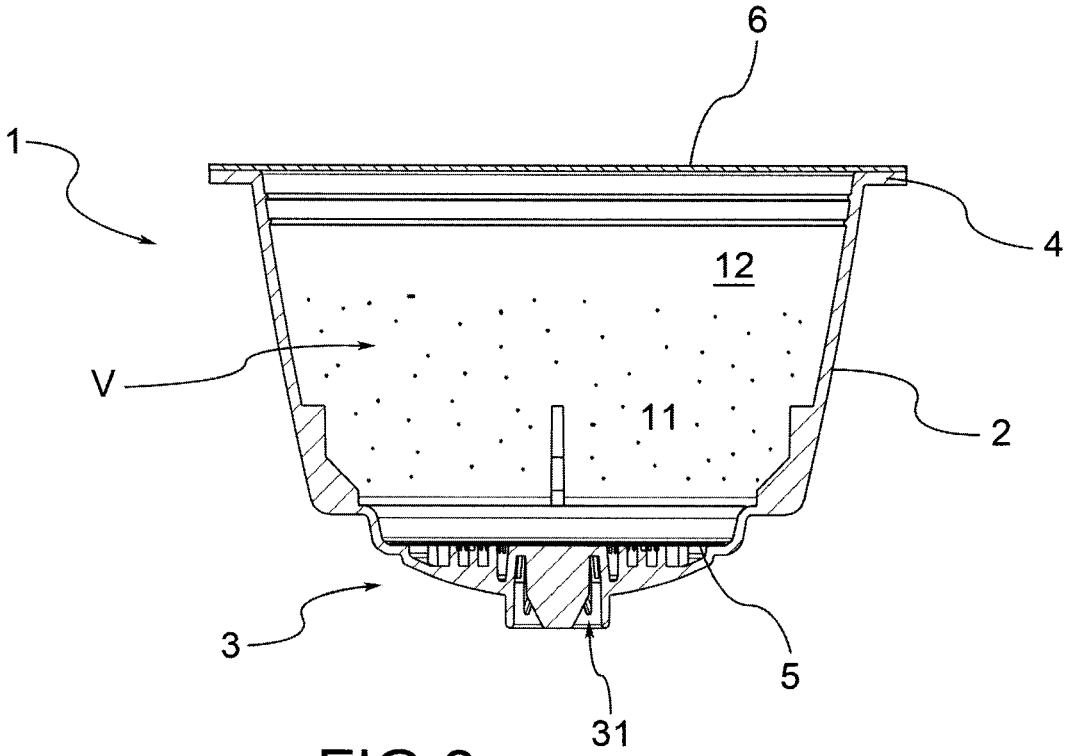
FIG. 8 is a sectional view of a capsule for the preparation of infused or soluble beverages according to this invention, in a yet further embodiment variant.

The accompanying figures, and in particular FIGS. 6 and 8, show a capsule for the preparation of infused or soluble beverages indicated with the reference number 1.

The capsule 1 comprises a body or cup 2 suitable to define an inner volume V for containing at least one substance 11 to be infused or dissolved, typically in powder or granular form.

The cup 2 is made of plastic material, preferably injection moulded or thermoformed. For example, the cup is made of polypropylene (PP), polyethylene (PE), polybutylene terephthalate (PBT) or polyethylene terephthalate (PET).

Figure 1:
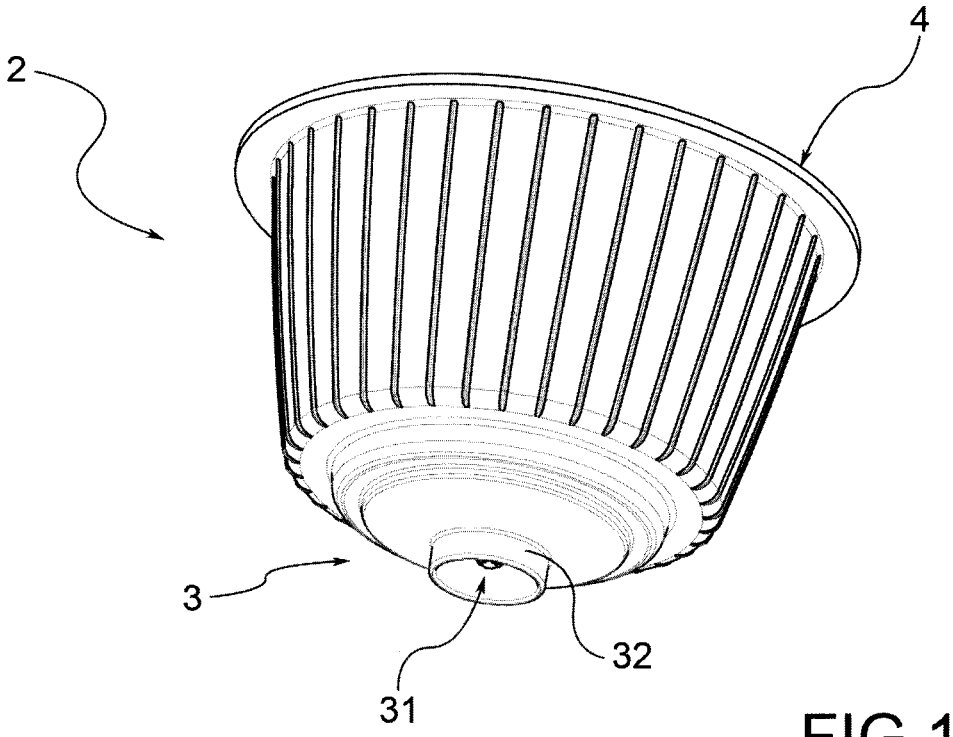
FIG. 1 is a perspective view from below of a capsule for the preparation of infused or soluble beverages according to this invention.
Figure 2:
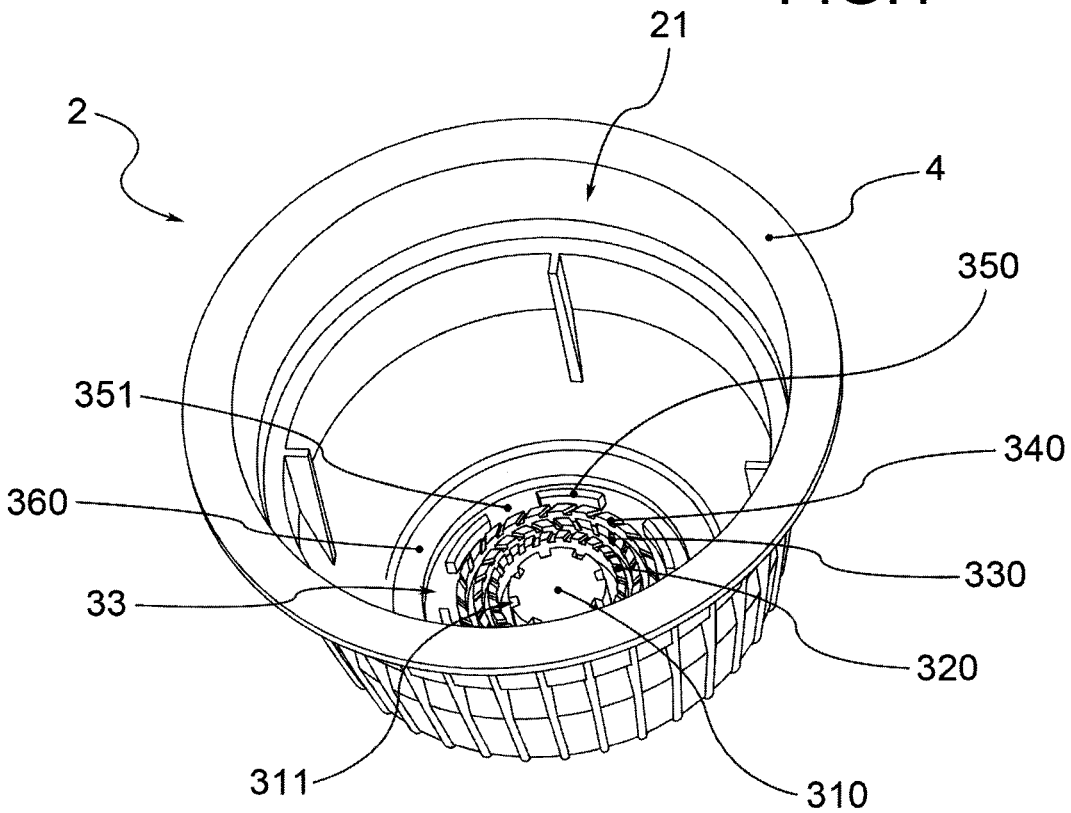
FIG. 2 is a perspective view from above of a capsule for the preparation of infused or soluble beverages according to this invention.

As shown in FIGS. 1 and 2, the cup 2 is provided, on one side, with a bottom 3 and, on the opposite side, an entrance opening 21 defined by an edge 4 protruding outwardly.

The cup 2 is provided, in correspondence of the bottom 3, with an exit opening 31, defined by a nozzle 32, suitable to allow the outflow of the infused beverage.

The cup 2 is provided, in correspondence of the bottom 3, with a base 33 provided with a plurality of reliefs 310,320, 330,340,350,360, protruding vertically with respect to the base 33 itself. The reliefs are protruding towards the inside of the cup 2, in the direction of the cover 6. Advantageously, the upper surface of the reliefs 310,320,330,340,350,360 is substantially flat and free of cutting, puncturing or lacerating elements. Advantageously, on the upper surface of at least some of the reliefs 310,320,330,340,360 is fixed, by gluing or welding, a sealing disc 5.

Figure 7:
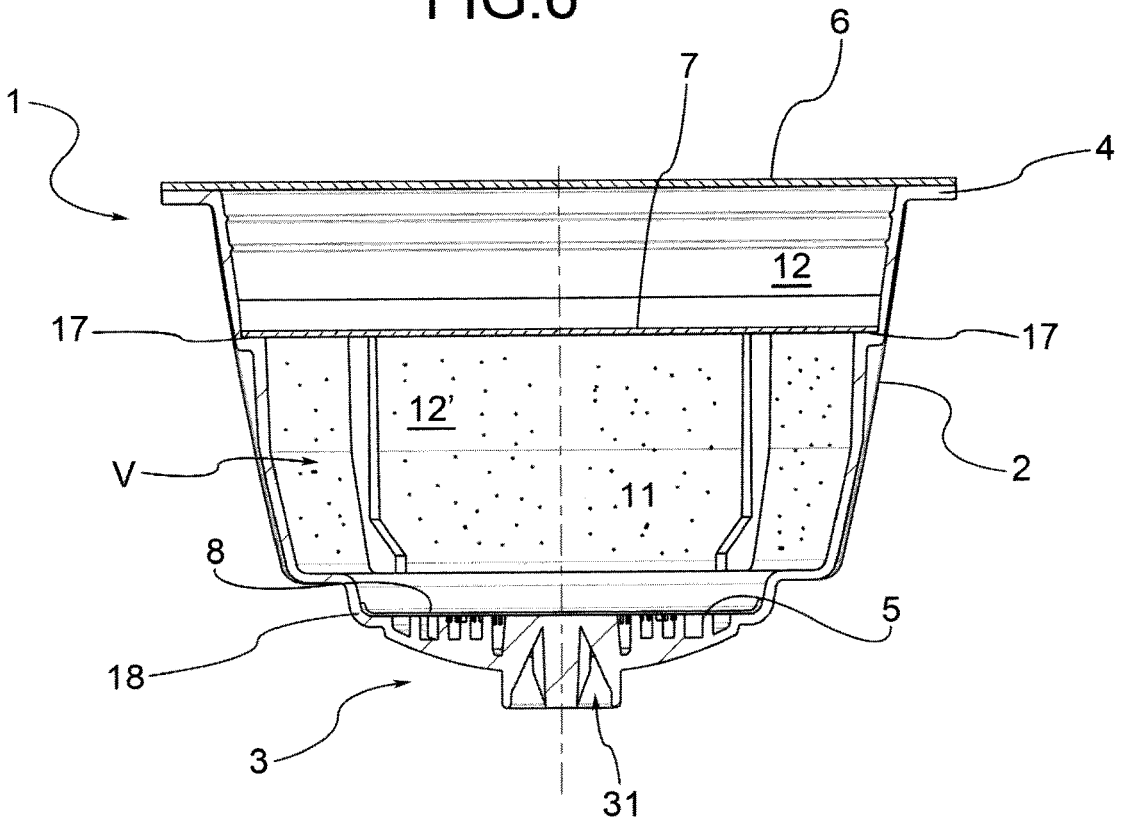
FIG. 7 is a sectional view of a capsule for the preparation of infused or soluble beverages according to this invention, in a further embodiment variant.

As shown in FIGS. 6, 7 and 8, the disc 5 is positioned between the inner volume V and the reliefs 310,320,330, 340,350,360.

The disc 5 is positioned between the substance 11 to be infused or dissolved, and the base 33, and in particular below the substance 11 and above the base 33.

The disc 5 closes the containment volume V of the substance, resting on the reliefs 310,320,330,340,350,360 that form the base 33.

Figure 3A:
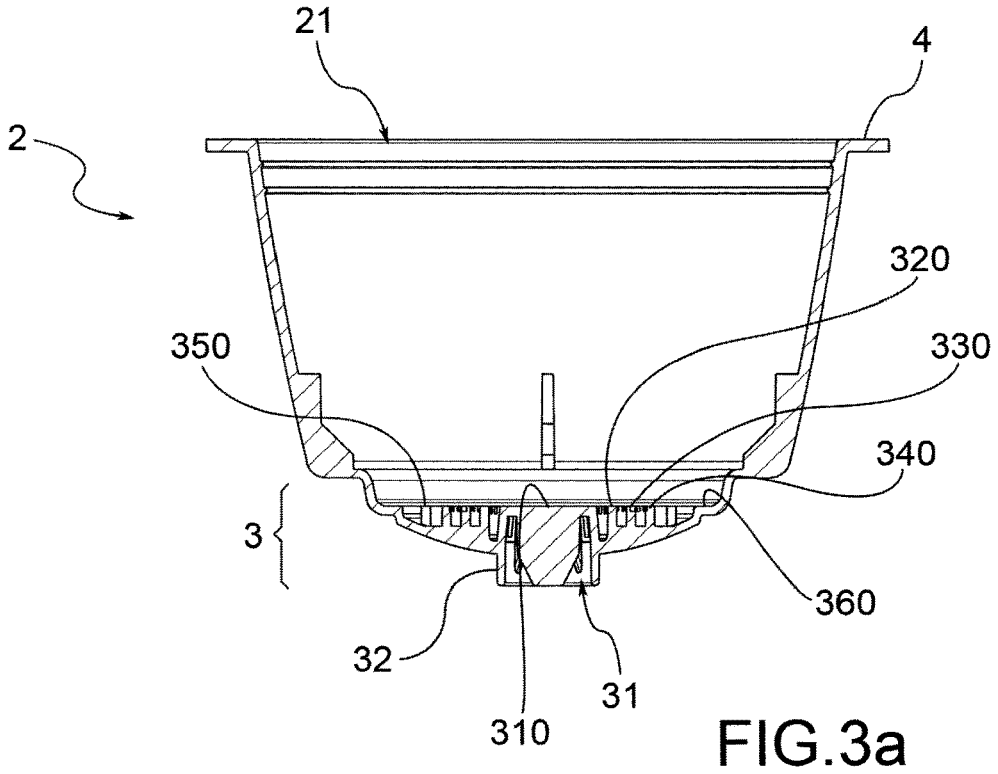
FIGS. 3 and 3A are, respectively, a top view and a sectional view of a capsule for the preparation of infused or soluble beverages according to this invention.
Figure 3:
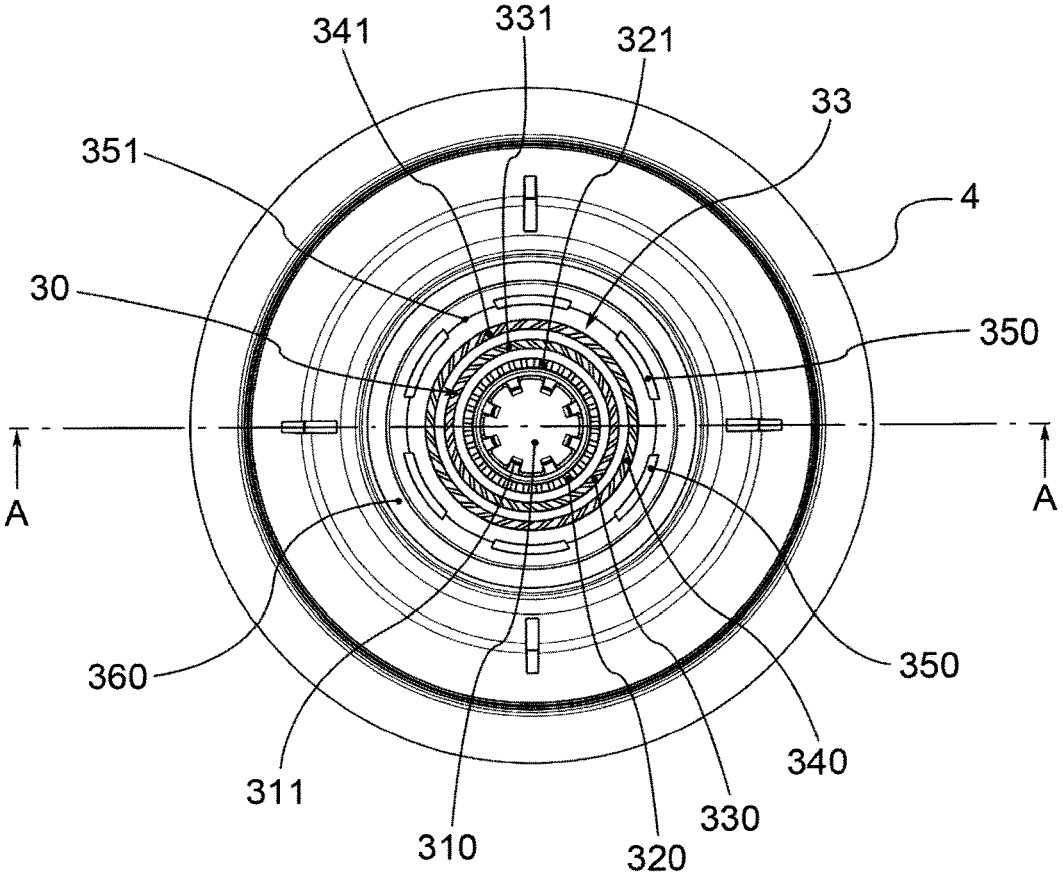

As shown in FIGS. 3 and 3A, the base 33 comprises a central portion 310, defined by a first relief, covering the exit opening 31 of the nozzle 32. The central portion 310 is provided with at least one connection opening 311 between the inside of the cup 2 and the exit opening 31, precisely to allow the outflow of the infused beverage to the outside of the capsule 1. Preferably, the central portion 310 comprises a plurality of connection openings 311.

The base 33 comprises at least one labyrinth portion 320,330,340, defined by a further relief.

The labyrinth portion 320,330,340 is of substantially circular shape, arranged concentrically with respect to the nozzle 32 (and to the central portion 310).

The labyrinth portion 320,330,340 is provided with a plurality of grooves 321,331,341. These grooves 321,331, 341, preferably diagonal, allow the outflow of the infused beverage to the outside of the capsule 1.

The base 33 thus comprises a labyrinth 30, defined by at least two labyrinth portions 320,330,340. In the embodiment variant shown in FIG. 3, the labyrinth 30 is defined by a first labyrinth portion 320, by a second labyrinth portion 330 and a third portion labyrinth 340 arranged concentrically with respect to the nozzle 32 (and to the central portion 310). Advantageously, the labyrinth 30 is suitable to prevent, by effect of capillarity, the passage of the infused beverage to the nozzle 32 when the pressure inside the capsule 1 drops below a threshold value, or ceases altogether when the capsule 1 is disengaged from the infusing group of the machine, to avoid dripping of the beverage itself. Advantageously, especially in the case of a capsule for the preparation of soluble beverages, the labyrinth 30 is suitable to reduce the output speed of the infused beverage. The outflow of the infused liquid contained in the capsule 1 occurs with regularity, even in the presence of a high internal pressure, due to the resistance offered by the narrow passages formed by the plurality of grooves 321,331,341.

The base 33 comprises an outer edge relief 360 (also referred herein as "relief 360," "edge 360," and "outer edge 360"), on which a sealing disc 5 is fixed in a partially releasable manner by gluing or welding.

Figure 11:
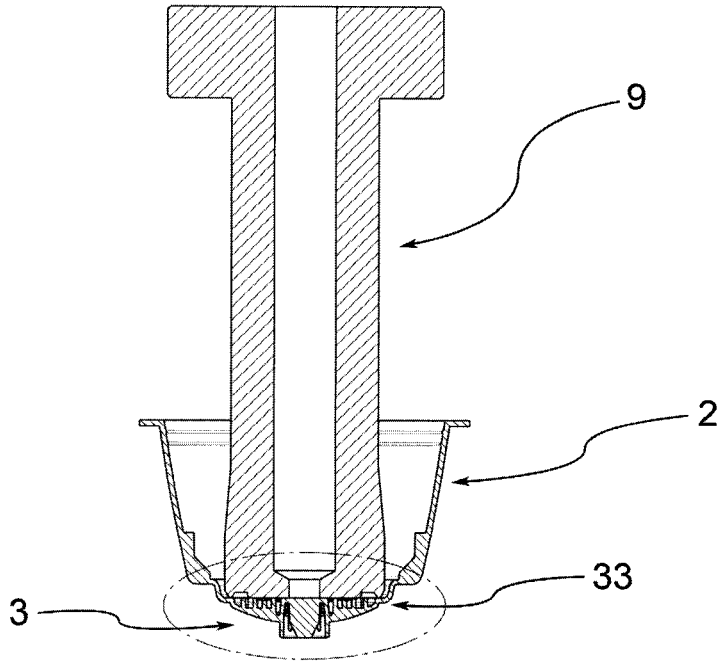
FIGS. 11 and 11A are, respectively, a sectional view and a detail of the welder of FIG. 10, in a step of welding the sealing disc on the bottom of the capsule.
Figure 11A:
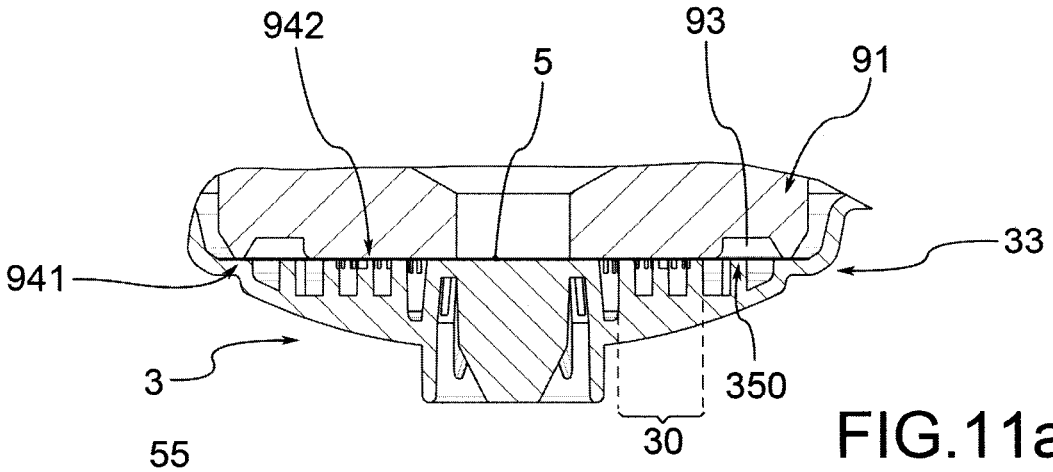
Figure 11B:
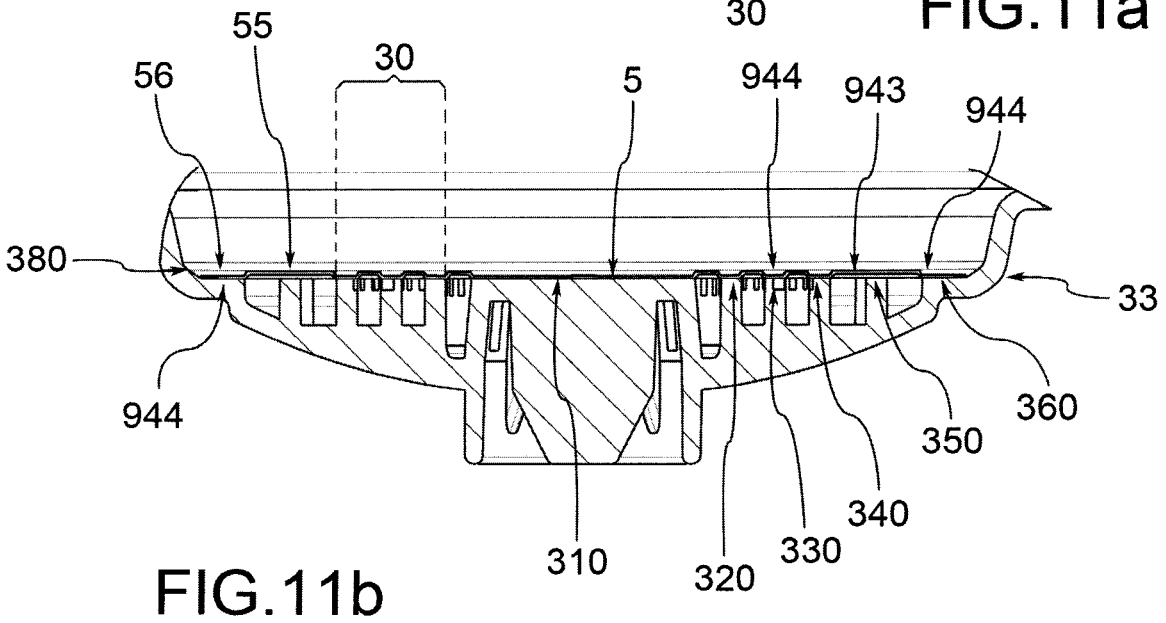
FIG. 11B shows a detail of the sealing disc welded on the bottom of the capsule, in an embodiment variant.

In an embodiment variant, shown in FIG. 11B, the relief 360 that defines the edge has substantially the same vertical extension of the other reliefs 310,320,330,340 that form the base 33.

In a further embodiment variant, shown in FIG. 12B, the edge 360 comprises at least one raised portion 361 that defines, for example, a central raised ring having substantially the same vertical extension of the other reliefs 310, 330,340 that form the base 33. The edge 360 comprises at least one recessed portion 363 having a lesser vertical extension with respect to the other reliefs 310,320,330,340 that form the base 33, and the raised portion 361. Advantageously, the presence of a recessed area 363 external to the raised area 361, in correspondence of which occurs the welding of the disc 5, allows channeling the pressurised liquid under the edge 51 so as to facilitate the detachment of the disc 5 from base 33. Advantageously, the presence of a recessed area 363 internal to the raised area 361, in correspondence of which occurs the welding of the disc 5, facilitates, once obtained the opening of the capsule, the outflow of the infused beverage.

As shown in FIG. 14, also in the variant in which the reliefs 310,320,330,340,350,360 have substantially the same vertical extension, recessed areas 363 can be prepared, for example in the form of radial grooves 363', 363". Preferably, the radial grooves 363',363" are homogeneously distributed in correspondence of the edge 360 of the base 33 of the bottom of the capsule. In particular, FIGS. 14 and 15A show several realisation examples of the radial grooves.

For example, FIG. 14 shows a capsule provided with a plurality of radial grooves 363' on the edge 360, in particular internally with respect to the area where the edge 51 of the disc 5 will be welded, so as to facilitate the outflow of the infused beverage once the opening of the capsule is obtained.

The left portion of FIG. 14, shows an example of a capsule provided with a high number of radial grooves 363' of reduced size; the right portion of FIG. 14, shows an example of a capsule provided with a lower number of radial grooves 363' of larger size.

For example, FIG. 15 shows a capsule provided with a plurality of radial grooves 363" on the edge 360, in particular externally with respect to the area where the edge 51 of the disc 5 will be welded, so as to channel the pressurised liquid under the disc 5 to facilitate its detachment. As shown in FIG. 15C, the welding of the disc 5 takes place in correspondence of a reduced portion of the edge 360, while the groove 363" allows channeling the pressurised liquid under the edge 51 of the disc 5.

The base 33 comprises a plurality of sectors 350, defined by further reliefs, arranged between the labyrinth 30 and the edge 360.

The circular sectors 350, substantially in the shape of an arc of circumference, are circumferentially arranged homogeneously with respect to the nozzle 32 (and to the central portion 310). Advantageously, the upper surface of the sectors 350 is substantially flat and free of cutting, puncturing or lacerating elements. Advantageously, a sealing disc 5 is supported on the upper surface of the sectors 350.

In an embodiment variant, shown in FIG. 11B, the reliefs 350 that defines the sectors 350 have substantially the same vertical extension of the other reliefs 310,320,330,340 that form the base 33.

In a further embodiment variant, shown in FIG. 12B, the reliefs 350 that defines the sectors 350 have a lesser vertical extension, which is to say they are lowered, with respect to the other reliefs 310,320,330,340 that form the base 33.

The sectors define a plurality of recesses 351, compartments or spaces that allow the outflow of the infused beverage to the outside of the capsule 1. In particular, a recess 351 is defined between a pair of adjacent sectors 350. In the embodiment variant of FIG. 3, the base 33 includes six sectors 350 and six recesses 351. Advantageously, the recess 351 defines a space suitable to accommodate, without obstructing it, the deformation of at least a portion of a sealing disc 5 when the pressure exerted by the fluid inside the capsule 1 reaches a certain opening threshold level.

Preferably, the circumferential extension of a sector 350 is greater than circumferential extension of a recess 351. This constructive choice allows the disc 5 to be freely deformable inside the recess 351, so as to form the crease 52 to open the passage P for the outflow of the infused beverage, and to be simultaneously supported by the sector 350, in such a way as to ensure an adequate width of the passage P for the proper and smooth outflow of the infused beverage.

As shown in FIGS. 6 to 8, the capsule 1 for the preparation of infused or soluble beverages, comprises a cover 6 fixed, by gluing or welding, in correspondence of the edge 4, suitable to seal the cup 2 on the top.

Preferably, the cover 6 is an aluminium film, or a composite plastic/aluminium material or a single- or multi-layer plastic.

Figure 4A:
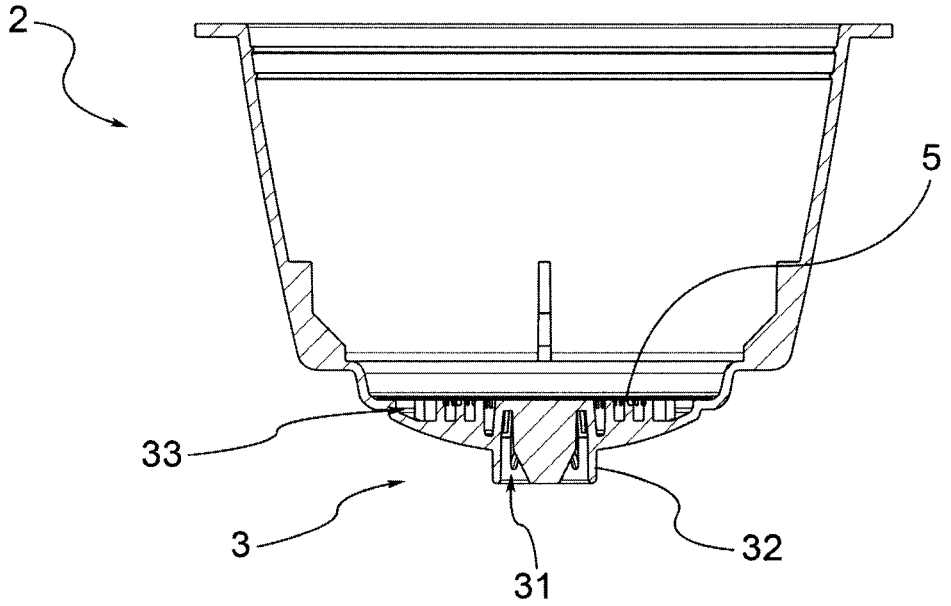
FIGS. 4 and 4A are, respectively, a top view and a sectional view of a capsule provided with a sealing disc on the bottom according to this invention, before infusion.
Figure 4:
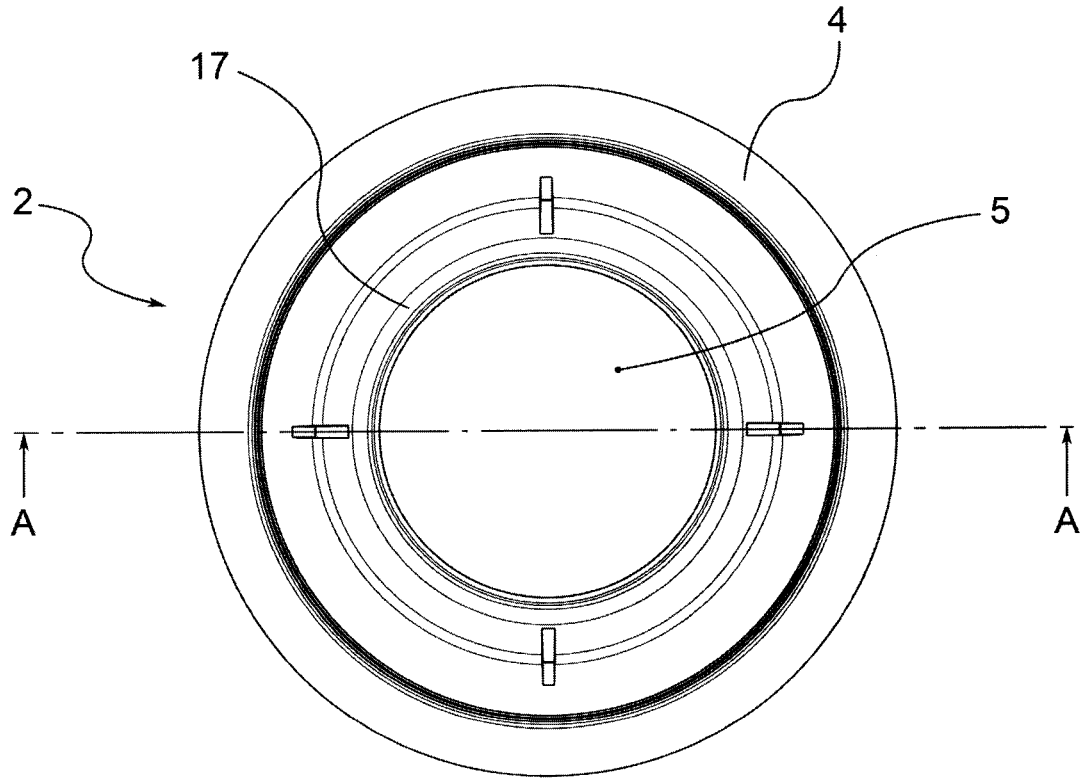

As shown in FIGS. 4 and 4A, the capsule 1 for the preparation of infused or soluble beverages, comprises a sealing disc 5 fixed inside the cup 2 in correspondence of the bottom 3, suitable to seal the cup 2 on the bottom.

The capsule 1 is thus provided with a closed chamber 12, defined by the cover 6 on the top and by the disc 5 on the bottom, inside which is contained the substance 11 to be infused or dissolved.

The presence of a hermetically closed chamber 12 is important for the good maintenance and preservation of the substance 11. The capsule 1 provided with a hermetically closed chamber 12 allows maintaining over time the organoleptic properties of the substance 11 to be infused or dissolve, and ensures a high quality of the infused beverage.

Preferably, the disc 5 is an aluminium film, or a composite plastic/aluminium material or a single- or multi-layer plastic.

Preferably, the disc 5 is a film with a thickness of at least 25μ.

Preferably, the disc 5 is a film with a thickness between 25μ and 45μ, still more preferably between 30μ and 40μ.

Preferably, the disc 5 is a film of strong aluminium, preferably with a thickness of 30μ.

This technical solution allows the disc 5 to be deformed due to the increase of pressure inside the capsule 1, without tearing or breaking.

The disc 5 is welded or glued in correspondence of the base 33 of the cup 2 in a manner at least partially releasable. Preferably, the disc 5 is welded or glued on the outer edge 360 in a releasable manner.

Preferably, the disc 5 is welded through the use of a sealing lacquer 89 having a low or bland level of adhesion, or glued by means of a glue with a low or bland level of adhesion, in such a way as to allow detachment or unsticking from the base 33 due to the increase of pressure inside the capsule 1.

Preferably, the lacquer ensures a lower detachment force than that of standard lacquers. For example, the detachment force measured after welding the disc 5 to the base 33 with a temperature of 240° C. for a time of 0.3 s and a force of 6 bar, much lower than 10 N/15 mm on a flat surface.

The disc 5 is welded or glued in correspondence of the bottom of the cup 2 and, in particular, is welded at least partially on the base 33. The disc 5 is welded or glued on the upper surface of at least some of the reliefs 310,320,330, 340,360.

The disc 5 is welded or glued to the outer edge 360 and on at least one of the labyrinth portions 320,330,340. Preferably, the disc 5 is welded or glued on the labyrinth 30, which is to say on all the labyrinth portions 320,330,340 that define the labyrinth 30 itself.

Preferably, the disc 5 is also glued or welded on the central portion 310.

The disc 5 is only supported, without being fixed, on at least some of the sectors 350. Preferably, the disc 5 is only supported on all the sectors 350. Advantageously, the sector 350 defines a support and sliding surface of at least a portion of the disk 5 during its deformation by the pressurised fluid in the capsule 1 when a certain opening pressure is reached.

This invention also relates to a method of a welding a sealing disc 5 to the base 33 of a capsule 1 according to this invention, wherein the disc 5 is welded in a releasable manner to an outside edge 360 of the base 33 using a welding lacquer 89 with a low level of adhesion. In particular, the disc 5 is also welded on labyrinth portions 320,330, 340 of the base 33 that define the labyrinth 30.

Preferably, the disc 5 is welded using a special welding tool 9, shown in FIG. 9.

The welding tool 9 comprises a body 92 provided on one side with a head 93, suitable to allow the gripping and handling of the tool 9, and one the opposite side with a welding base 91.

In the embodiment variant shown in FIGS. 12 and 12A, preferably usable for welding a disc 5 on a base 33 in which the sectors 350 are recessed and the edge 360 comprises at least one recessed portion 363 with respect to the other reliefs 310,320,330,340 that form the base 33, the base 91 of the welder 9 is provided with a welding profile 94 substantially flat.

In this embodiment variant, as shown in FIG. 12B, the disc 5 is welded in correspondence of the labyrinth 30, preferably also of the central portion 310, and at least partially in correspondence of the edge 360, in particular in correspondence of the raised portion 361.

In this embodiment variant, is formed at least one welding area 944 (labyrinth 30, preferably the central portion 310, the raised portion 361) and at least one free area 943 (reliefs 350, recessed portion 363) in which no welding takes place.

In particular, with regard to the edge 360, the sealing area 944, corresponding to only the raised portion 361, is of reduced width or in any case less with respect to the total width of the edge 360 of the base 33. Advantageously, the presence of a welding area of reduced width in correspondence of the edge 360 facilitates the detachment of the disc 5 due to the increase of pressure inside the capsule 1.

In the embodiment variants shown in FIGS. 10 to 11A and 13 and 13A, preferably usable for the welding of a disc 5 on a base 33 in which the reliefs 310,320,330,340,350,360 have substantially the same vertical extension, the base 91 is provided with a welding profile 94 suitable to weld the disc 5 only in correspondence of some portions of the base 33.

As shown in FIGS. 11, 11A and 11B, the welding profile 94 comprises a central portion 942 suitable to weld the disc 5 in correspondence of the labyrinth 30, preferably also of the central portion 310, and of a contour portion 941 suitable to weld at least partially the disc 5 in correspondence of the edge 360.

The welding profile 94 is provided, between the central portion 942 and the contour portion 941, with a channel 93 suitable to define a free area 943 in which no welding takes place.

Preferably, the base 91 being of the tool 9 being substantially cylindrical, the channel 93 is substantially circular and concentric with respect to the base 91.

The central portion 942 of the welding profile 94 is substantially flat and defines a welding area 944 of the same width as the labyrinth 30, and preferably also of the central portion 310, of the base 33.

The contour portion 941 of the welding profile 94 is defined by a tooth 95 that defines a welding area 944 of reduced width or in any case less than the width of the edge 360 of the base 33.

Advantageously, the presence of a welding area of reduced width in correspondence of the edge 360 of the base 33 facilitates the detachment of the disc 33 due to the increase of pressure inside the capsule 1.

In the embodiment variant shown in FIGS. 13 and 13A, the disc 5 is welded at least partially in correspondence of walls 380 inclined or vertical.

In this variant, the welding profile 94 comprises a central portion 942 suitable to weld the disc 5 in correspondence of the labyrinth 30, preferably also of the central portion 310, and of a lateral portion 941 suitable to weld at least partially the disc 5 in correspondence of the walls 380.

The welding profile 94 is provided, between the central portion 942 and the lateral portion 945, with a channel 93 suitable to define a free area 943 in which no welding takes place. In this variant, the channel 93 extends to the lateral portion 945.

This invention also relates to a welding tool 9 for welding a sealing disc 5 to the base 33 of a capsule 1 according to this invention, provided with a welding base 91 with a welding profile 94 comprising a central portion 942 and a contour portion 941 suitable to make a weld, and a channel 93, provided between the central portion 942 and the contour portion 941, suitable to define a free area 943 in which there is no welding.

As shown in FIGS. 6 to 8, the capsule 1 can be realised in various versions.

FIGS. 6 and 7 show a capsule for the preparation of infused beverages, in particular coffee.

Preferably, in such embodiment variants, the capsule 1 for coffee also comprises a filter 8 welded or glued under the substance 11 on suitable vertical abutments 18 provided inside the cup 2. Preferably, the filter 8 is welded or glued in correspondence of the inner walls of the cup 2, just above the bottom 3. In particular, the filter 8 is welded or glued above the disc 5. The presence of the filter 8, preferably made of paper, fabric or non-woven fabric, below the substance 11, and in particular of the coffee powder, allows filtering the infused liquid before it flows out from the capsule 1, in this way preventing coffee powder residues from remaining in the infused beverage and impairing its quality.

Preferably, in these embodiment variants, the capsule 1 for coffee also comprises a permeable or micro-perforated film 7, welded or glued above the substance 11 on special horizontal abutments 17 provided inside the cup 2.

Inside the chamber 12, the film 7 defines, together with the disc 5, a sub-chamber 12' within which the substance 11 to be infused is effectively contained. The presence of this film 7, which allows the passage of the pressurised fluid but not the passage of the substance 11, prevents the dispersion of the coffee powder during the infusion step, improving the quality of the infused beverage.

With particular reference to the embodiment variant of FIG. 6, which shows a capsule 1 for the preparation of infused coffee, the cup 2 comprises, inside a dividing wall 13, preferably circular, suitable to define the lateral walls of the sub-chamber 12' within which the substance 11 to be infused is effectively contained. In this embodiment variant, the film 7 is fixed in correspondence of the upper edge of the dividing wall 13, an edge that in this case represents the horizontal abutment 17 for gluing or welding.

The embodiment variant of FIG. 8 shows a capsule for the preparation of soluble beverages, such as for example tea, chocolate or milk. Preferably, in this embodiment variant, the capsule 1 for soluble substances comprises the cover 6 and the sealing disc 5, and is without filter 8 and permeable or micro-perforated film 7.

The capsule 1, in its various embodiment variants, can be used for the extemporaneous preparation of beverages (such as tea, coffee, herbal tea, milk, chocolate, etc.) using automatic or semi-automatic machines equipped with a dispenser group suitable to produce an infusion through the passage of hot water under pressure through the capsule 1.

So, in use, the capsule 1 is inserted in a suitable seat provided in the machine. The machine pierces the cover 6, placed to close the capsule 1, and inserts, inside the chamber 12,12' in which the substance 11 is contained, a pressurised fluid (mostly hot water).

The presence of the disc 5 to closure of the bottom 3 of the capsule 1 allows the pressurised fluid to remain, for a certain interval of time, in contact with the substance 11 to be infused or dissolved, so as to ensure obtaining an optimum infused beverage. The pressure exerted by the fluid inside the capsule 1 rises until reaching a certain threshold level, or opening pressure (for example comprised between 4 and 8 bar), which pushes on the disc 5 determining the opening of the capsule 1. At this point the infused beverage can flow out through the exit opening 31 and be directed, via the nozzle 32, into the cup or final container.

Figure 5A:
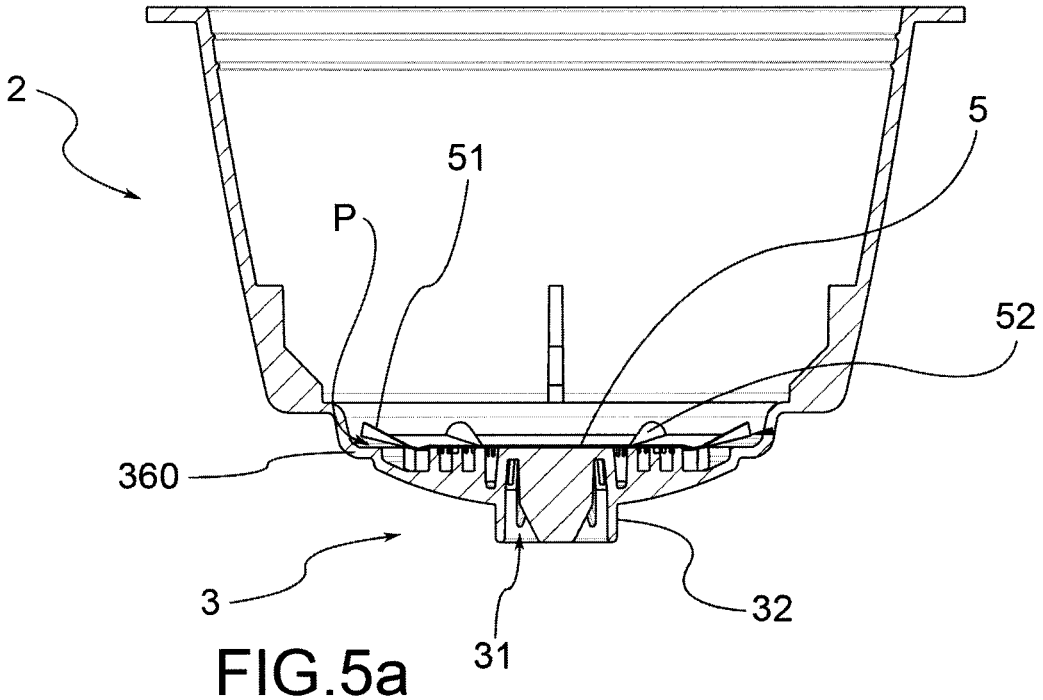
FIGS. 5 and 5A are, respectively, a top view and a sectional view of a capsule provided with a sealing disc on the bottom according to this invention, after infusion.
Figure 5:
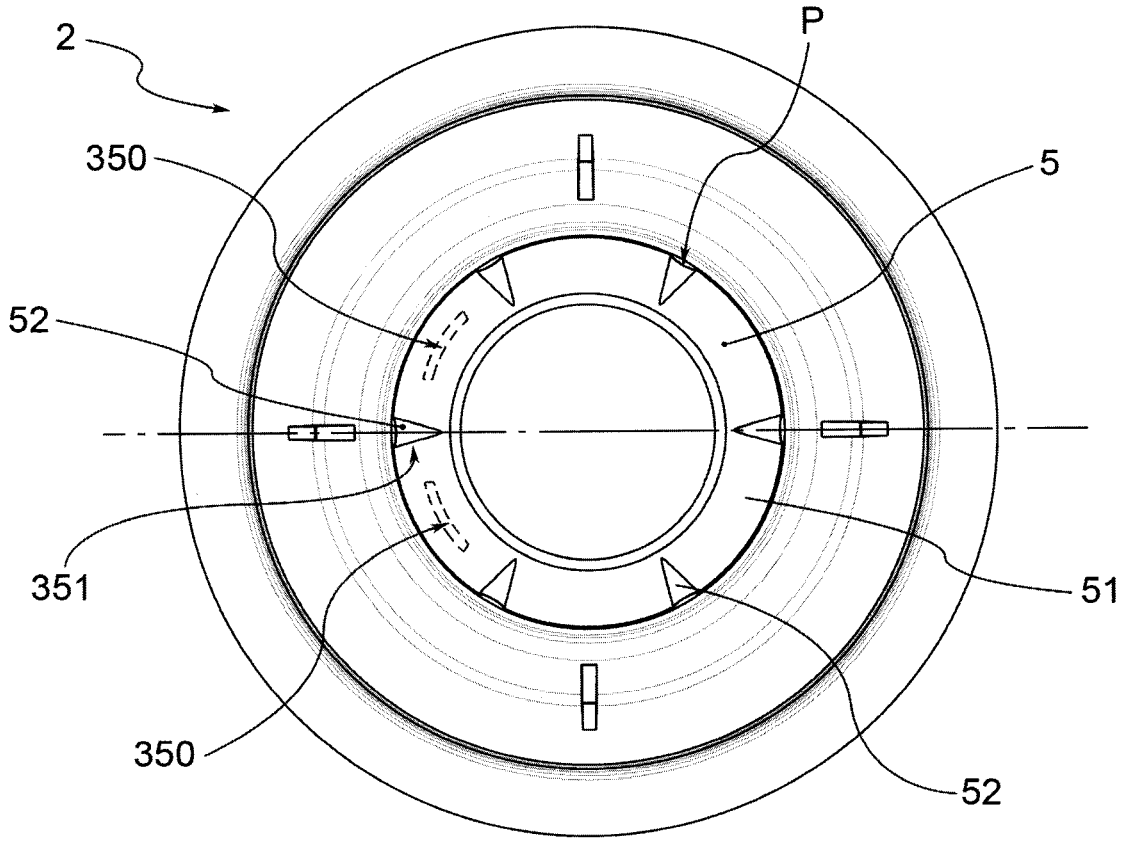

In particular, as shown in FIGS. 5 and 5A, the opening of the capsule 1 is determined by the deformation, at least partial, of the disc 5.

Due to the increase of pressure inside the capsule 1, the disc 5 becomes slightly convex, which is to say the edge 51 is slightly raised with respect to the edge 360 of the base 33.

Due to the increase of pressure inside the capsule 1, the edge 51 of the disc 5 is detached or unstuck, at least partially, preferably completely, from the base 33. The unsticking occurs at least in correspondence of the edge 51 of the disc 5 and the edge 360 of the base 33. This unsticking obviates the sealing effect previously provided by the sealing disc 5.

Always due to the increase of pressure inside the capsule 1, the edge 51 of the disc 5 is deformed with a certain undulation and forms a crease 52, preferably a plurality of creases 52.

The deformation of the disc 5, and in particular the crease 52, determines a separation of the disc 5 from the base 33, at least in correspondence of the edge 360, such as to allow the opening of a passage P for the outflow of the infused liquid.

In particular, the edge 51 of the disc 5 forms a crease 52 in correspondence of at least one recess 351. Preferably, the edge 51 of the disc 5 forms a crease 52 in correspondence of each recess 351.

Advantageously, the disc 5, being supported only on the upper surface of the sectors. 350, without being welded or glued on them, can freely slide on the sectors 350 during the deformation due to the increase of pressure inside the capsule 1. Moreover, the presence of the recesses 351 allows accommodating, without obstructing it, the deformation of the disc 5 due to the increase of pressure inside the capsule 1. Therefore, precisely in correspondence of the recesses 351, the creases 52 are formed.

This technical solution allows the disc 5 to be deformed without tearing or breaking.

In the capsule 1 according to this invention, the exit passage P for the infused beverage, between the chamber 12, 12' and the nozzle 32, is created spontaneously by just the increase in pressure exerted by the pressurised fluid in the capsule 1, without the need for means of piercing or tearing of the disc, points or cutting profiles.

This invention also relates to a method for preparing an infused beverage using a capsule 1 according to this invention, wherein the opening to allow the outflow of the infused beverage is determined the detachment or unsticking, at least partial, of the disc 5 from the base 33 and by the subsequent deformation, at least partial, of the disc 5 itself.

In particular, the unsticking of the disc 5 takes place in correspondence of the edge 360 of the base 33 so as to obviate the sealing effect previously provided by the disc 5. The deformation of the disc 5 takes place on the 51 of the disc 5 which forms, at least at a recess 351, a crease 52 suitable to permit the release of the infused beverage.

A capsule according to this invention is usable for the packaging of concentrated products (in the form of powder, granules or leaves) in predetermined and disposable doses, for the extemporaneous preparation of beverages such as tea in leaves or soluble, coffee in powder or instant coffee, herbal tea, milk, chocolate, or other dehydrated, water-soluble products.

Innovatively, a capsule for the preparation of infused or soluble beverages according to this invention is of simple construction and, in any case, able to ensure high performance in terms of quality of the infused beverage.

Advantageously, a capsule for the preparation of infused or soluble beverages according to this invention allows maintaining over time the organoleptic properties of the substance contained inside it and thus ensures an excellent quality of the infused beverage.

Advantageously, in a capsule for the preparation of infused or soluble beverages according to this invention, the pressurised fluid passes through the substance to be infused in an optimal way with possible effects on the quality of the infused beverage.

Advantageously, in a capsule for the preparation of infused or soluble beverages according to this invention, the opening, to allow the infused beverage to flow out, occurs as a result of the deformation of the sealing disc, placed to cover the bottom, due to the pressure exerted by the pressurised fluid inside it, thus avoiding recourse to any means of cutting or piercing.

Advantageously, in a capsule for the preparation of infused or soluble beverages according to this invention, the infused beverage is never in contact with parts or elements of the machine used for the preparation of the beverage itself, without risks of alteration of the taste in the case of preparation of different types of beverages.

It is clear that one skilled in the art may make changes to the capsule for the preparation of infused or soluble beverages described above, all contained within the scope of protection defined by the following claims.

The invention claimed is:

1. A capsule for the preparation of a beverage from at least one infusible or dissolvable substance, the capsule comprising:

a cup defining an inner volume containing at least one substance to be infused or dissolved in a fluid to produce a beverage, the cup being closed above by a cover, the cup comprising a bottom, provided with an opening adapted to permit the release of the beverage, and a base provided with a plurality of reliefs having an upper surface devoid of cutting or puncture elements; and a disc, placed inside the cup on the upper surface of the plurality of reliefs of the base, the disc welded or glued to at least a portion of the upper surface so as to be at least partially detachable from the portion of the upper surface to which the disc is glued or welded, as a result of a pressure increase inside the capsule reaching a threshold, wherein the disc seals the capsule containing the beverage when the pressure is below the threshold and the disc deforms to release the beverage as a result of deformation of the disc by the pressure exerted by the beverage inside the capsule when the pressure has reached the threshold.

2. The capsule according to claim 1, wherein an outer edge of the base is defined by one of the plurality of reliefs, and the disc is also attached in a partially releasable manner on the outer edge of the base, using a lacquer.

3. The capsule according to claim 1, wherein a portion of the plurality of reliefs defines a plurality of sectors on the upper surface of which rests the disc.

4. The capsule according to claim 1, wherein a plurality of sectors define a plurality of recesses suitable to house the deformation of the disc when the pressure exerted by the beverage inside the capsule reaches the threshold.

5. The capsule according to claim 1, wherein the base comprises a labyrinth defined by at least two labyrinth portions, a portion of the plurality of reliefs define the at least two labyrinth portions, the at least two labyrinth portions each comprise a plurality of grooves for the release of the beverage, and wherein the disc is also glued or welded onto the at least two labyrinth portions.

6. The capsule according to claim 1, wherein the disc is a film of aluminium or plastic/aluminium composite or single layer or multi-layered plastic and has a thickness of between 25μ and 45μ.

7. The capsule according to claim 1, comprising a filter attached under the at least one substance on suitable vertical abutments provided inside the cup.

8. The capsule according to claim 1, comprising a micro-perforated or permeable film set above the at least one substance on horizontal abutments provided inside the cup.

9. The capsule according to claim 1, wherein the inner volume of the cup comprises a dividing wall defining a sub-chamber containing the at least one substance to be infused or dissolved.

10. The capsule according to claim 1, wherein the cover is fixed on an edge of the cup and closes an entrance opening of the capsule so as to define the inner volume as hermetically closed by the cover and the disc.

11. A method of preparing a beverage from a capsule containing an infusible or dissolvable substance, comprising:

providing the capsule comprising:

a cup comprising an entrance opening defined by an edge of the cup, a bottom of the cup provided with an exit opening, and a base provided with a plurality of reliefs having an upper surface devoid of cutting or puncture elements;

a disc, placed inside the cup on the upper surface of the plurality of reliefs of the base, the disc welded or glued to at least a portion of the upper surface so as to be at least partially detachable from the portions of the upper surface to which the disc is welded or glued as a result of a pressure increase inside the capsule reaching a threshold, wherein the disc seals the capsule containing the beverage prepared from the substance to be infused or dissolved, when the pressure is below the threshold and the disc at least partially deforms to release the beverage as a result of deformation of the disc by the pressure exerted by the beverage inside the capsule when the pressure has reached the threshold; and a cover closes the entrance opening of the capsule so as to define a chamber hermetically closed by the cover and the disc, the chamber containing the infusible or dissolvable substance; and inserting a pressurised fluid into the chamber, the pressurised fluid contacting the substance to be infused or dissolved to produce the beverage; and in response to the pressure exerted by the pressurised fluid inside the chamber reaching the threshold, releasing the beverage obtained from the infusible or dissolvable substance by the at least partial detachment of the disc from the portions of the upper surface to which the disc is welded or glued and by the at least partial deformation of said disc.

12. The method of preparing an infused beverage, according to claim 11, wherein the disc is also glued or welded in an at least partially detachable manner, at an edge of the base or a side wall of the cup above the base and is also at least partially detached from the edge of the base or the side wall as a result of the pressure reaching the threshold so as to obviate the seal previously provided by the disc.

13. The method of preparing the beverage, according to claim 11, wherein an edge of the disc is also glued or welded to an edge of the base, and as a result of the pressure reaching the threshold at least partial detachment and deformation of the disc also takes place on the edge of the disc which forms, at least at a recess, a crease that releases the beverage.

14. A method of a welding a disc to the base of a capsule according to claim 1, comprising, welding the disc to the at least a portion of the upper surface of the plurality of reliefs using a welding lacquer, wherein the welding seals the disc to the capsule.

15. The method according to claim 14 wherein the welding lacquer ensures a detachment force, measured after welding at a temperature of 240° C. for a time of 0.3 s and a force of 6 bar, that is lower than 10 N/15 mm on a flat surface.

16. The method according to claim 14, wherein the base comprises labyrinth portions that define a labyrinth, and the disc is also welded onto the labyrinth portions.

17. The capsule according to claim 1, wherein an outer edge of the base is defined by one of the plurality of reliefs, and the disc is attached in a partially releasable manner on a side wall above the base at the outer edge, using a lacquer having a low or bland level of adhesion.

18. A capsule for the preparation of a beverage from at least one substance to be infused or dissolved, the capsule comprising:

a cup defining an inner volume containing at least one substance to be infused or dissolved in a fluid to prepare a beverage, the cup having an upper opening closed by a cover, the cup comprising a bottom provided with an opening adapted to permit the release of the beverage, and a base provided with a plurality of reliefs having an upper surface devoid of cutting or puncture elements, an outer edge of the base is defined by one of the plurality of reliefs, and a plurality of radial grooves evenly distributed on the outer edge of the base; and a disc, placed inside the cup on the upper surface of the plurality of reliefs of the base, the disc is attached on the outer edge of the base or on a side wall above the base, using an adhesive lacquer, so as to be at least partially detachable from the outer edge of the base or the side wall as a result of a pressure increase inside the capsule reaching a threshold, wherein the disc seals the capsule containing the beverage when the pressure is below the threshold and the disc deforms to release the beverage as a result of deformation of the disc by the pressure exerted by the beverage inside the capsule when the pressure has reached the threshold.

* * * * *